US006338422B1

(12) United States Patent
DeJonge

(10) Patent No.: US 6,338,422 B1
(45) Date of Patent: Jan. 15, 2002

(54) ACTUATION DEVICE FOR MANUALLY OPERATED PUMP SPRAYER

(75) Inventor: Stuart DeJonge, Easton, PA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/685,133

(22) Filed: Oct. 11, 2000

(51) Int. Cl.[7] ..... B67D 5/64
(52) U.S. Cl. ..... 222/162; 222/383.1
(58) Field of Search ..... 222/162, 182, 222/183, 321.1, 321.8, 383.1, 320, 340, 378, 402.13; 239/333

(56) References Cited

U.S. PATENT DOCUMENTS 3,405,843 A * 10/1968 Watson, Jr. ..... 222/95
4,345,718 A * 8/1982 Horvath ..... 239/333
5,377,869 A 1/1995 Weiss et al.
5,487,489 A 1/1996 Weiss et al.
6,196,419 B1 * 3/2001 Haney et al. ..... 222/79

* cited by examiner

*Primary Examiner*—Kenneth Bomberg
*Assistant Examiner*—Melvin A. Cartagena
(74) *Attorney, Agent, or Firm*—Dykema Gossett PLLC

(57) ABSTRACT

An actuation device capable of adapting a conventional pump dispenser into a lever or trigger sprayer, the actuation device having a housing comprised of a first part that is removably connected to a second part and when the two parts are connected, a pump dispenser is received within the housing. The first part of the housing has an opening adjacent the nozzle of the pump dispenser that allows the contents of the pump dispenser to be sprayed out through the opening. A lever is hingedly mounted to the housing via a plurality of trunnions and associated trunnion cradles and has a leg portion that makes holding and squeezing the lever easy and comfortable. The lever also has at least one arm disposed adjacent an annular rim of the skirt of the pump dispenser so that when the lever is moved, the arm of the lever presses against the annular rim and causes the pump dispenser to actuate and spray fluid from the pump dispenser to the target.

5 Claims, 1 Drawing Sheet

ACTUATION DEVICE FOR MANUALLY OPERATED PUMP SPRAYER

BACKGROUND OF THE INVENTION

This invention relates generally to an apparatus that will assist a user when actuating a pump sprayer and more particularly to an actuation device that enables a user to operate a pump sprayer as a lever or trigger sprayer by providing a lever that actuates the pump sprayer when pushed or pulled.

A need exists for a device that can adapt a pump sprayer or fine mist sprayer into a lever or trigger sprayer allowing the sprayer to be easily gripped and the contents of the pump sprayer to be readily expelled from its interior.

While the conventional pump sprayer provides a means of directly dispensing its contents, such pump sprayers and fine mist sprayers can be difficult for elderly people, handicapped people and small children to manipulate due to the configuration of the pump being located on the upper end of the dispenser. Such pump mechanisms also require a suficient amount of manual dexterity and the ability of the user to apply one or two fingers to actuate the pump, while holding the pump dispenser with the remainder of the hand. If a person does not have a strong grip, or good strong use of their individual fingers, pumping can be a difficult and trying task.

In the art, there currently exists a device for dispensing chemicals from a pressurized container as disclosed in the U.S. patent issued to Fox et al. (U.S. Pat. No. 4,402,430). This device is for a hand-held holder that has a casing for holding chemical cartridges therein. The casing has an opening at one end with a movable frame that moves freely within the casing. A chemical cartridge is placed within the frame and slid into the casing through the opening. A valve at one end of the frame is provided to engage the cartridge and dispense the contents therein. A lever is pivotally connected to the casing and holds the chemical container in a relatively fixed position while driving the frame through the casing which in turn causes a valve to move toward and into engagement with the chemical cartridge, thus causing the contents of the chemical cartridge to dispense therefrom.

While the Fox device provides a means of dispensing the contents of a chemical cartridge by using a lever mechanism, the contents are not dispensed through a conventional pump dispenser. Also, assembling the dispensing unit by having to place the chemical cartridge into the frame and then into the holder can be cumbersome and difficult for people with arthritis or limited use of their hands, or for those who have limited manual dexterity.

The Fox device does not provide an alternative form of actuation for a conventional pump dispenser as does the present invention. The Fox device merely provides a mechanism for discharging the contents of a chemical cartridge.

SUMMARY OF THE INVENTION

It is an object of the present invention to provide a lever that adapts a conventional pump sprayer into a lever or trigger sprayer making it easier for a user to actuate the pump sprayer.

Another object of the present invention is to provide an apparatus that makes the use of a conventional pump sprayer more ergonomic for users that may have disabilities or are incapable of actuating a pump sprayer through the traditional pumping motion.

The actuation device for manually operated pump sprayers has a housing comprised of multiple parts. A first part of the housing is connected to a second part of the housing with a collar. The housing fully encapsulates a pump dispenser and has an opening adjacent to and in alignment with the nozzle of the pump dispenser that allows the contents of the pump dispenser to be sprayed out through the nozzle and through the opening out to the target.

A lever is hingedly mounted to the housing and has a leg portion that renders pushing or pulling the lever easier. The lever also has at least one arm that abuts an annular shoulder on the skirt of the pump dispenser so that when the lever is actuated, the arm causes the pump dispenser to shift relative to its pump plunger so as to effect discharge of spray product to the intended target.

Other objects, advantages and novel features of the invention will become more apparent from the following detailed description of the invention when taken in conjunction with the accompanying drawings.

DETAILED DESCRIPTION OF THE INVENTION

Figure 1:
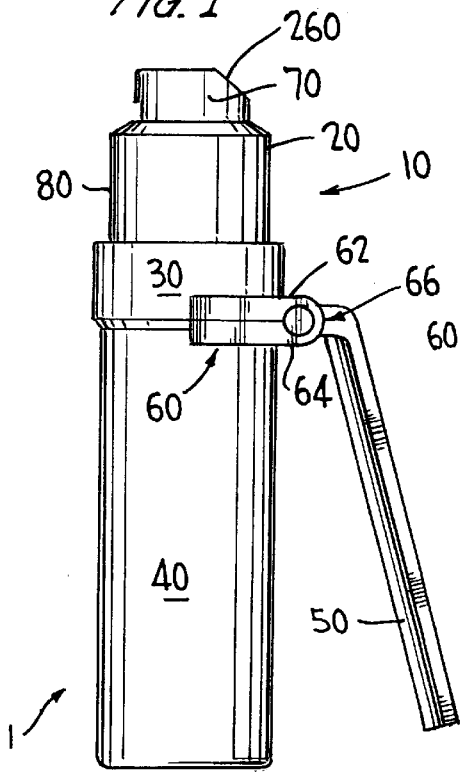
FIG. 1 is a side elevational view of the actuation device of the present invention.
Figure 3:
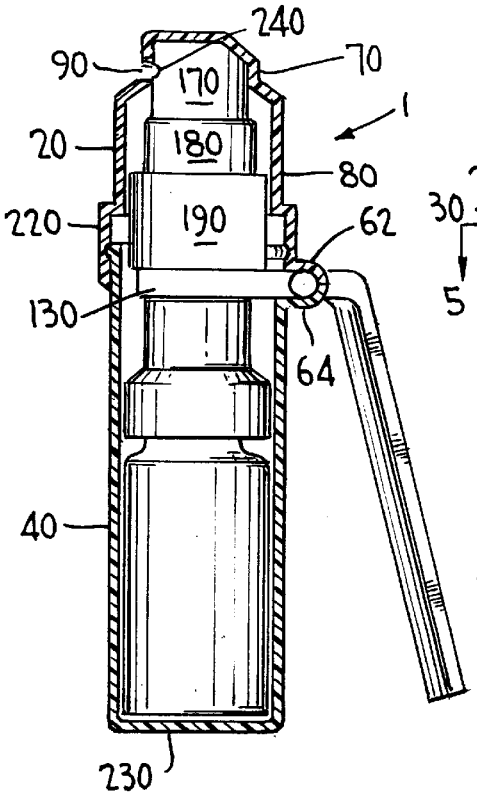
FIG. 3 is a view similar to FIG. 1 with the housing of the actuation device being shown in vertical section with the lever in an at rest position.
Figure 4:
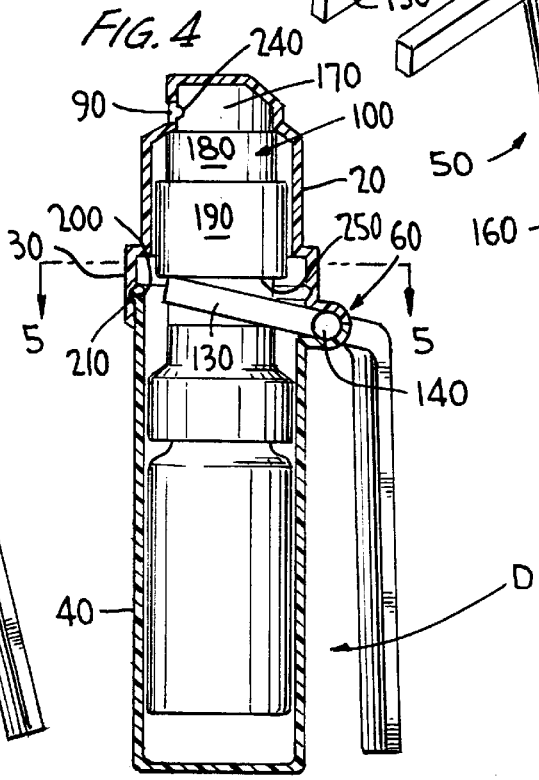
FIG. 4 is a view similar to FIG. 3, with the lever actuated.

As shown in FIG. 1, the actuation device generally designated 1 for manually operated pump dispensers has a housing 10 with a first part 20 connected by the provision of a collar 30 to a second part 40. The collar 30 is snap-fitted with the second part 40 via a groove 200 and mating annular bead 210 (as shown in FIGS. 3 & 4). When the first part 20 is connected with the second part 40, each part has a portion that extends outwardly and forms mounting means 60. A lever 50 is hingedly mounted to the housing 10 with mounting means 60.

The first part 20 of the housing 10 is designed to fit around and enclose a conventional pump dispenser 100 such as a pump sprayer or fine mist sprayer 100. The first part 20 has an upper section 70, a middle section 80 and a lower section or collar 30.

The upper section 70 is complimentary in shape to that of the plunger head 170 of the pump sprayer 100. In the preferred embodiment, the upper section 70 has a smaller diameter than that of the middle section 80 and one side 260 is angled. The angled side 260 of the upper section 70 helps to maintain the first part 20 of the housing 10 in a specific location or orientation relative to the pump sprayer 100. Conventional pump sprayers 100 typically have a nozzle 240 on one side of the head 170 and the side opposite the head 170 is angled in some fashion so as to provide a comfortable recessed pad for a finger to be pressed upon when pumping the sprayer 100. Also, as well known in the art, the pump sprayer has a plunger head 170 which is manually reciprocable relative to mid-section or collar 180 which is upstanding from closure skirt 190. Liquid product is thus sprayed to the target upon plunger reciprocation.

In the present invention, since the upper section 70 of the first part 20 of the housing 10 is contoured similarly to the head 170 of the pump sprayer 100, an aperture 90 in the upper section 70 is placed in axial alignment and adjacent the nozzle 240 of the pump sprayer 100 when the angled side 260 is located adjacent the angled portion of the head 170 of the pump dispenser 100.

The middle section 80 of the first part 20 of the housing 10 also has a smaller diameter than the collar 30. however, various sizes and shapes are foreseeable so long as they match the contour of the underlying pump dispenser 100. For example, the upper section 70 and middle section 80 could have the same diameter if the pump dispenser 100 is so shaped.

The diameter of the upper section 70 is slightly larger than the head portion 170 of the pump dispenser 100 allowing for the upper section 70 of the first part 20 to fit snugly around the head 170 of the pump dispenser 100 encapsulating the head 170 while keeping the aperture 90 of the first part 70 aligned with the nozzle 240 of the pump dispenser 100.

The collar 30 of the first part 20 of the housing 10 has a larger diameter than the second part 40 of the housing 10 so that the collar 30 securely fits over the open end 230 of the second part 40 and the annular bead 210 of the collar 30 fits within the groove 200 of the second part 40, securing the first part 20 and the second part 40 together.

Also, the first part 20 in the invention depicted in the Figures is shown as being on the top of the second part 40, however it is foreseeable that the first part 20 could actually be adapted to fit within the second part 40 or both the first and second parts 20,40 could be side-by-side and snap-fit together in a vertical plane (clam shell fashion) instead of the horizontal one shown in FIG. 1.

Located on the lower, outside perimeter of the first part 20 is at least a first cradle arm 62 (FIGS. 2 and 5) that is integrally formed therewith and has one end that protrudes out from the first part 20 in a hook-shape forming one side of a mounting means 60. Each first cradle arm 62 matingly connects with a respective similar second cradle arm 64 that is located on the exterior portion of the second part 40 of the housing 10 at the open end 220.

When the first part 20 is connected to the second part 40, the first cradle arms 62 matingly abut with the second cradle arms 64 forming a trunnion cradle 66 with a central axis A—A (shown in FIG. 5) about which the lever 50 rotates.

Figure 6:
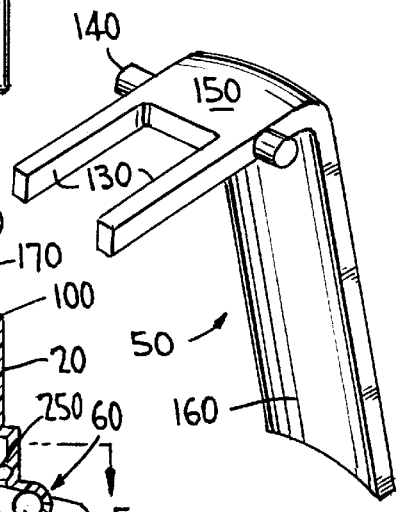
FIG. 6 is a perspective view of the lever of the actuation device of the present invention.

The lever 50, as shown in detail in FIG. 6, has at least one trunnion 140 protruding out from the body 150. In the preferred embodiment, the lever 50 has two trunnions 140, one located on either side of the body 150 of the lever 50. Each trunnion 140 is mounted within each respective trunnion cradle 66 when the actuation device I is fully assembled thereby forming a pivotal axis about which the lever 50 rotates.

The body 150 of the lever 50 is connected to a leg 160 at an angle. While the angle may vary, in the present embodiment, the body 150 may be integrally formed with the leg 160 at an angle slightly greater than 90 degrees.

Figure 5:
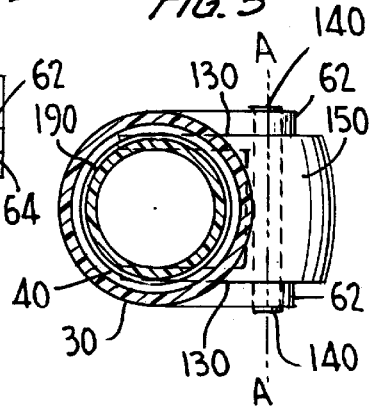
FIG. 5 is a cross-sectional view of the upper portion of the actuation device taken along line 5—5 in FIG. 4.

The body 150 of the lever 50 also has a plurality of arms 130 protruding out therefrom and also angled with the leg 160. In this embodiment, there are two arms 130, one located on either side of the body 150 so that an arm 130 will be located on either side of the pump dispenser 100 as shown in FIG. 5 when the actuation device 1 is fully assembled. However, it is foreseeable that any desired number of arms 130 could be provided either straight as shown or curved.

Figure 2:
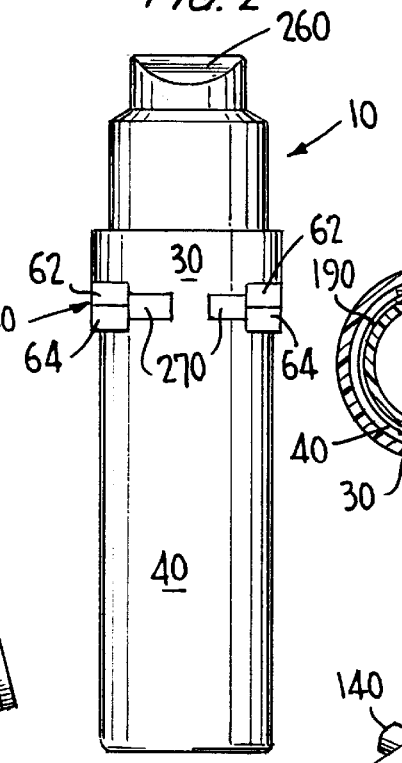
FIG. 2 is a rear elevational view of the device of FIG. 1 with the lever being omitted for clarity.

The arms 130 project into the interior of the assembled actuation device 1 through corresponding arm slots 270 as shown in FIG. 2.

The arm slot 270 may be comprised of a single aperture for all arms 130, or a plurality of apertures in the housing 10 as shown, each corresponding to each separate arm 270. The arm slot 270 is also located between the trunnion cradles 60 on one side of the actuation device 1.

Each arm 130 is placed through the arm slot 270 so that it is disposed under and adjacent the closure 190 of the pump dispenser 100 as shown in FIG. 5. The lower end of the closure 190 has an annular rim 250 that rests against the upper surface of each arm 130.

When the leg 160 of the lever 50 is pivoted, the lever 50 rotates on the trunnions 140 causing the arms 130 to move upwardly, thereby shifting the annular rim 250 of the closure 190 upward and activating the pump mechanism within the pump dispenser 100.

FIGS. 3 and 4 show the second part 40 of the housing 10 as having an open or first end 220 and a closed or second end 230, which is opposite the open end 220.

The open end 220 of the second part 40 has an external annular bead 210 around the outside perimeter thereof, which matingly fits within a groove 200 that extends around the inside perimeter of the collar 30.

When the first part 20 of the housing 10 is snap-fit with the second part 40 of the housing 10, the bead 210 fits into groove 200 and locks the first part 20 with the second part 40 creating a hollow interior wherein a pump dispenser 100 can be received. The connection of the first part 20 and the second part 40 also secure the first cradle arm 62 in a position adjacent the second cradle arm 64 thereby forming the trunnion cradle 66.

Although the actuation device 1 is shown in the Figures with a Vial Access Spike Adapter, it not so limited but is capable of use with any known, standard finger actuated pump sprayer.

The Vial Access Spike Adapter shown in the Figure is more fully disclosed in application Ser. No. 09/640,550 filed Aug. 17, 2000, now U.S. Pat. No. 6,269,976, and commonly owned herewith. In brief, a conventional pump dispenser is connected to a vial with a vial access spike adapter allowing for the contents of the vial to be directly dispensed therefrom.

The pump sprayer operates in a reciprocating pumping action when activated. In normal use, the operator depressed the head of the pump dispenser which lowers it into the nozzle mid-section and activates the pumping mechanism within the pump dispenser causing the contents of the vial to be expelled.

The actuation device 1 is easily assembled, is economically manufactured, can be used with standard, conventional dispensers and provides an easy, handy, useful pump adapter for use with pump sprayers 100.

The actuation device 1 can be operated as a trigger sprayer or a lever sprayer when fully assembled. To operate the actuation device 1 as a trigger sprayer, with head 170 and section 80 disposed such that aperture 90 and nozzle 240 extend in the same direction as lever 50, i.e., to the righ in FIGS. 1, 4 and 4, the operator grasps the second part 40 of the housing 10 in the palm portion of the hand while wrapping the fingers around the leg 160 of the lever 50. The application of a slight squeezing motion of the fingers pulls the leg 160 toward the housing 10 in the direction of arrow D, causing the arms 130 of the lever 50 to rotate in an upward motion about the axis of trunnion 140. As the arms 130 are rotated upwardly, they push the annular rim 250 of the pump dispenser 100 upwardly thereby activating the pumping mechanism within the pump dispenser 100. FIG. 4 discloses the actuation device 1 with the arms 130 in a raised position.

Upon release of the leg 160 of the lever 50, the actuation device 1 will reset itself into a rest position in response to a return spring (not shown) within the conventional pump dispenser 100. The rest position of the actuation device 1 is shown in FIG. 3. The return spring provides a constant downward force on the closure 190, which in turn pushes the arms 130 of the lever 50 down into a resting position, resetting the actuation device 1 so that is may be used again.

To operate the actuation device 1 as a lever sprayer as shown in the drawings, the user grasps the second part 40 of the housing 10 within the fingers in such a manner that the leg 160 of the lever 50 is placed in the palm portion of the hand. The application of a slight squeezing motion of the fingers pushes the leg 160 of the lever 50 towards the second part 40 of the housing 10 in the direction of arrow D (FIG. 4) causing the arms 130 of the lever 50 to rotate upwardly.

As the arms 130 are rotated upwardly, they push the annular rim 250 of the pump dispenser 100 in an upward movement activating the pumping mechanism within the pump dispenser 100.

Upon release of the leg 160 of the lever 50, the actuation device 1 will reset itself into a rest position as described previously.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A manually actuated pump dispenser having an actuation device, the dispenser comprising a relatively reciprocable pump plunger having a plunger head with a nozzle through which product issues upon pump operation, the plunger being mounted via a closure skirt on a container of liquid to be dispensed, the device comprising a housing for the reception of the pump dispenser, the housing including a first part receiving said head and having an aperture aligned with said nozzle, the actuation device further comprising a lever pivotally mounted on said housing, said lever engaging a lever receptive rim on said dispenser for movement of said rim relative to said plunger head upon lever actuation to dispense the contents of the dispenser.

2. The pump dispenser according to claim 1, wherein said lever comprises at least one arm in engagement with said rim, and further comprises a leg angularly disposed to said arm and adapted to be manually moved toward the housing.

3. The pump dispenser according to claim 2, wherein said lever comprises a pair of spaced arms in engagement with said rim.

4. The pump dispenser according to claim 1, wherein said closure skirt has an annular rim comprising said lever receptive rim.

5. The pump dispenser according to claim 1, wherein said first part of said housing and said plunger head are complementary in shape for maintaining the alignment of said nozzle and said aperture.

* * * * *

US006338422C1

(12) EX PARTE REEXAMINATION CERTIFICATE (7369th)

United States Patent

DeJonge

(10) Number: US 6,338,422 C1

(45) Certificate Issued: Feb. 16, 2010

(54) ACTUATION DEVICE FOR MANUALLY OPERATED PUMP SPRAYER

(75) Inventor: Stuart DeJonge, Easton, PA (US)

(73) Assignee: Calmar Inc., City of Industry, CA (US)

Reexamination Request:
No. 90/006,751, Aug. 19, 2003

Reexamination Certificate for:

| | |
|---|---|
| Patent No.: | **6,338,422** |
| Issued: | **Jan. 15, 2002** |
| Appl. No.: | **09/685,133** |
| Filed: | **Oct. 11, 2000** |

(51) Int. Cl.
*B67D 5/64* (2006.01)

(52) U.S. Cl. ..... 222/162; 222/383.1

(58) Field of Classification Search ..... None
See application file for complete search history.

(56) References Cited

U.S. PATENT DOCUMENTS

| | | | | |
|---|---|---|---|---|
| 3,726,442 | A | 4/1973 | Davidson et al. | 222/207 |
| 3,995,776 | A | 12/1976 | Micallef | 222/207 |
| 4,167,245 | A | 9/1979 | Kock et al. | 239/11 |
| 4,185,776 | A | 1/1980 | Nozawa | 239/333 |
| 5,370,281 | A | 12/1994 | Renault | 222/341 |
| 5,839,621 | A | 11/1998 | Tada | 222/383 |

FOREIGN PATENT DOCUMENTS

| | | | |
|---|---|---|---|
| DE | G 90 11 901.0 | | 12/1990 |
| DE | 4015367 | | 11/1991 |
| DE | 4027699 | | 12/1991 |
| DE | 4027672 | | 3/1992 |
| DE | 4030531 | | 4/1992 |
| DE | 4115774 | | 11/1992 |
| DE | 41 37 799 | | 5/1993 |
| DE | 4128295 | | 11/1994 |
| DE | 44 11 031 | | 1/1995 |
| DE | 196 10 456 | A1 | 9/1997 |
| DE | 19756442 | | 1/2002 |
| EP | 0475094 | | 5/1993 |
| EP | 0 636 421 | A1 | 2/1995 |
| EP | 0 662 352 | A1 | 7/1995 |
| EP | 092 3993 | | 1/2002 |
| GB | 659132 | | 10/1951 |
| GB | 1097254 | | 1/1968 |
| GB | 2 161 222 | | 1/1986 |
| JP | 10043648 | | 2/1998 |
| WO | 97/12686 | | 4/1997 |

*Primary Examiner*—Aaron J. Lewis

(57) ABSTRACT

An actuation device capable of adapting a conventional pump dispenser into a lever or trigger sprayer, the actuation device having a housing comprised of a first part that is removably connected to a second part and when the two parts are connected, a pump dispenser is received within the housing. The first part of the housing has an opening adjustment the nozzle of the pump dispenser that allows the contents of the pump dispenser to be sprayed out through the opening. A lever is hingedly mounted to the housing via a plurality of trunnions and associated trunnion cradles and has a leg portion that makes holding and squeezing the lever easy and comfortable. The lever also has at least one arm disposed adjacent an annular rim of the skirt of the pump dispenser so that when the lever is moved, the arm of the lever presses against the annular rim and causes the pump dispenser to actuate and spray fluid from the pump dispenser to the target.

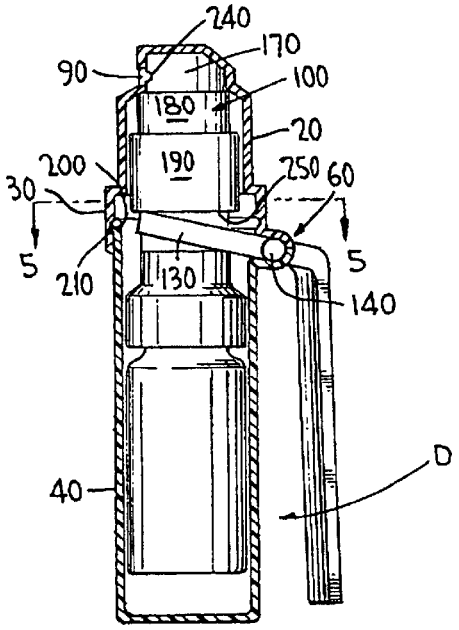

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–5 are cancelled.

* * * * *